US011219348B2

(12) United States Patent
Yang et al.

(10) Patent No.: US 11,219,348 B2
(45) Date of Patent: Jan. 11, 2022

(54) CLEANING DEVICE WITH AUXILIARY CLEANER

(71) Applicant: Hye Jung Yang, Siheung-si (KR)

(72) Inventors: Hye Jung Yang, Siheung-si (KR); Du Young Yang, Siheung-si (KR)

(73) Assignee: Hye Jung Yang, Siheung-si (KR)

( * ) Notice: Subject to any disclaimer, the term of this patent is extended or adjusted under 35 U.S.C. 154(b) by 0 days.

(21) Appl. No.: 16/799,728

(22) Filed: Feb. 24, 2020

(65) Prior Publication Data

US 2020/0205637 A1 Jul. 2, 2020

Related U.S. Application Data

(63) Continuation of application No. PCT/KR2019/006154, filed on May 23, 2019.

(30) Foreign Application Priority Data

Dec. 19, 2018 (KR) ..... 10-2018-0165350

(51) Int. Cl.
*A47L 13/08* (2006.01)
*A47L 13/022* (2006.01)

(52) U.S. Cl.
CPC ..... *A47L 13/08* (2013.01); *A47L 13/022* (2013.01)

(58) Field of Classification Search
CPC ..... A47L 13/02; A47L 13/022; A47L 13/08; A47L 13/10; A47L 13/11; A47L 1/06; E01H 5/02; A01D 7/00; B60S 3/045
USPC ..... 15/245, 245.1, 236.01, 236.02, 236.08; D32/41, 48–49
See application file for complete search history.

(56) References Cited

U.S. PATENT DOCUMENTS

D20,152 S * 9/1890 Smith et al. ..... D32/41
2,904,807 A * 9/1959 Obergfell ..... A47L 1/06 15/105
5,787,588 A * 8/1998 Tisbo ..... A01B 1/00 294/54.5
2016/0045089 A1* 2/2016 Beu ..... B65D 85/54 206/349

(Continued)

FOREIGN PATENT DOCUMENTS

CA 2573829 * 10/2014 ..... E01H 5/02
FR 2789289 * 8/2000 ..... A47L 1/06
JP 3070453 U 8/2000

(Continued)

OTHER PUBLICATIONS

English translation of KR 10-2014-0074532 A, Yang, Jun. 2014. (Year: 2014).*

(Continued)

*Primary Examiner* — Laura C Guidotti
(74) *Attorney, Agent, or Firm* — Revolution IP, PLLC

(57) ABSTRACT

Disclosed is a cleaning device with an auxiliary cleaner. More particularly, a cleaning device having an auxiliary cleaner includes a bar-shaped grip extending in a vertical direction, a rigid main cleaner having a tubular housing coupled to a bottom of the grip and a plurality of frames extending from a bottom of the housing and spaced apart from each other by a predefined spacing, and the auxiliary cleaner coupled to a bottom of the main cleaner, wherein the auxiliary cleaner contacts a cleaning target as the main cleaner deforms.

5 Claims, 6 Drawing Sheets

(56) References Cited

U.S. PATENT DOCUMENTS

2019/0283086 A1* 9/2019 Schindler ..... B08B 1/00

FOREIGN PATENT DOCUMENTS

| | | | | | |
|---|---|---|---|---|---|
| KR | 20-1995-0003961 | Y1 | | 5/1995 | |
| KR | 10-0430041 | B1 | | 9/2004 | |
| KR | 20-2009-0004363 | U | | 5/2009 | |
| KR | 2014-0074532 | A | * | 6/2014 | ..... A47L 13/02 |
| KR | 10-1432074 | B1 | | 8/2014 | |

OTHER PUBLICATIONS

Office Action issued in KR 10-2018-0165350; mailed by the Korean Intellectual Property Office dated Apr. 30, 2019.
Office Action issued in KR 10-2018-0165350; mailed by the Korean Intellectual Property Office dated Mar. 28, 2019.

* cited by examiner

CLEANING DEVICE WITH AUXILIARY CLEANER

CROSS-REFERENCE TO RELATED APPLICATIONS

The present application is a continuation of International Patent Application No. PCT/KR2019/006154, filed on May 23, 2019 which is based upon and claims the benefit of priority to Korean Patent Application No. 10-2018-0165350 filed on Dec. 19, 2018. The disclosures of the above-listed applications are hereby incorporated by reference herein in their entirety.

BACKGROUND

Embodiments of the inventive concept described herein relate to a cleaning device with an auxiliary cleaner. More particularly, embodiments of the inventive concept described herein relate to a cleaning device having an auxiliary cleaner in which a main cleaner and an auxiliary cleaner are integrally formed with each other, and an main protrusion and an auxiliary protrusion are formed on the auxiliary cleaner to easily clean a dirt between an unevenness and a groove.

Recently, a vacuum cleaner is widely used for cleaning. However, the vacuum cleaner has a relatively large volume and requires power. Thus, a demand for a broom-type manual cleaning device has not ceased.

Each of all of conventional broom-type cleaning devices has a plurality of hairs although the broom-type cleaning devices have slightly different hair shapes.

However, in the conventional broom-type cleaning device, the hair may be easily removed and deformed. In particular, management thereof may be difficult because foreign matters are caught between the hairs during cleaning. In addition, when cleaning is performed without removing the foreign matters, the foreign matters may be removed from the hairs during the cleaning. This results in a sanitary problem.

Further, when there is a liquid such as water on a floor, the conventional broom-type cleaning device does not effectively clean the liquid. To make matters worse, the foreign matters and the liquid are mixed with each other to increase a dirty level.

In order to overcome the above problems, the present inventor previously disclosed "a cleaning device having an auxiliary cleaner" in Korean Patent No. 10-1432074 (issued on Aug. 13, 2014). In this prior art document, the cleaning device includes a grip that a user may grip, a main cleaner having a first face formed to extend in a left and right direction such that a bottom contacts a cleaning target, and a second face formed to correspond to the first face and opposite to the first face, and being connected to the grip and being flexible, and an auxiliary cleaner which protrudes toward at least one of the first face and the second face, and contacts the cleaning target as the main cleaner deforms.

The above prior art has an advantage that deformation is prevented because the main and auxiliary cleaners are formed integrally with each other. However, the above prior art has a disadvantage that it is cumbersome to clean and sterilize the auxiliary cleaner, and the main cleaner does not firmly support the auxiliary cleaner when sweeping a floor.

Therefore, there is a need for a method for solving the above problem of the prior art.

SUMMARY

Embodiments of the inventive concept provide a cleaning device having an auxiliary cleaner having a new structure in which a main cleaner and the auxiliary cleaner are integrally formed with each other, and a main protrusion and an auxiliary protrusion are formed on the auxiliary cleaner to easily clean a dirt between an unevenness and a groove.

According to an exemplary embodiment, a cleaning device having an auxiliary cleaner includes a bar-shaped grip extending in a vertical direction, a rigid main cleaner having a tubular housing coupled to a bottom of the grip and a plurality of frames extending from a bottom of the housing and spaced apart from each other by a predefined spacing, the auxiliary cleaner coupled to a bottom of the main cleaner, wherein the auxiliary cleaner contacts a cleaning target as the main cleaner deforms, wherein the main cleaner includes a main frame extending vertically from the bottom of the housing, wherein the main frame includes a first frame extending in an inclined manner and in a streamline shape from one side of an outer surface of the housing, a second frame extending in a curved shape from the other side of the outer surface of the housing, and a plurality of middle frames vertically extending from the bottom of the housing and disposed between the first and second frames and arranged horizontally, and a reinforcing frame including a first reinforcing frame connecting vertical middle portions of the first and second and middle frames of the main frame with each other in a horizontal direction, and a second reinforcing frame connecting bottoms of the first and second and middle frames of the main frame with each other in a horizontal direction, wherein the second reinforcing frame is spaced downwardly from the first reinforcing frame, and a twist-preventing portion to integrally connect the main frame to the bottom of the housing.

In one embodiment of the cleaning device, the main cleaner may have spaces defined between the main frame and the reinforcing frame.

In one embodiment of the cleaning device, the main cleaner may further include a coupler extending from the second reinforcing frame in a plate shape, a plurality of coupling grooves passing through one surface of the coupler, and coupling protrusions disposed adjacent to the coupling grooves and protruding from both side surfaces of the coupler.

In one embodiment of the cleaning device, the auxiliary cleaner may include a plate-shaped scraper connected to a bottom of the main cleaner and having both lateral ends inclined downwards and outwardly, a plurality of main protrusions arranged along a longitudinal direction of the scraper and protruding from both lower surfaces of the scraper, and upper and lower auxiliary protrusions protruding in a form of a wall along a longitudinal direction of the scraper and disposed above and below the main protrusions.

In one embodiment of the cleaning device, the cleaning device may be fabricated by forming the main cleaner via first molding, and inserting the first molded main cleaner into a mold and performing second molding to form the auxiliary cleaner such that the main cleaner is integrally coupled to the auxiliary cleaner via the coupler while the auxiliary cleaner surrounds the coupler.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
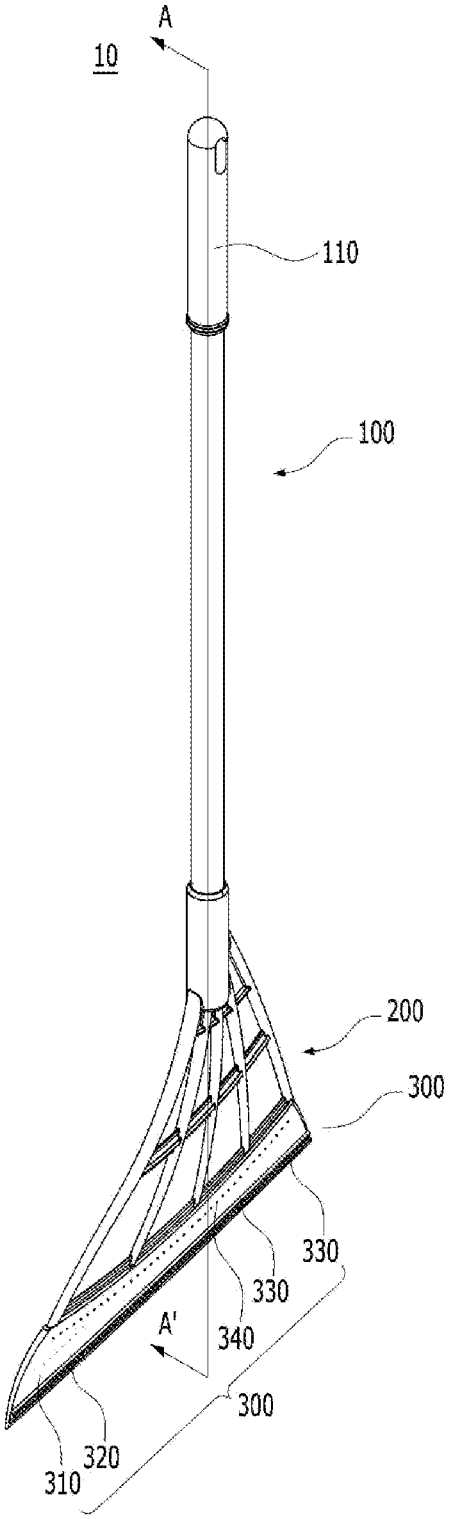
FIG. 1 is a front view showing an overall shape of a cleaning device having an auxiliary cleaner according to an embodiment of the inventive concept.

Hereinafter, a preferred embodiment that may be easily implemented by those of ordinary skill in the art will be described in detail with reference to the accompanying drawings. However, in describing an operating principle of the preferred embodiment of the inventive concept in detail, when it is determined that a detailed description of a related known function or component may unnecessarily obscure a gist of the inventive concept, the detailed description thereof will be omitted.

Further, the same reference numerals are used for parts having similar functions and operations throughout the drawings.

In addition, it will be understood that when an element or layer is referred to as being "connected to", or "coupled to" another element or layer, it may be directly on, connected to, or coupled to the other element or layer, or one or more intervening elements or layers may be present. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof.

Hereinafter, a cleaning device having an auxiliary cleaner according to a preferred embodiment of the inventive concept will be described in detail with reference to the accompanying drawings.

Figure 2:
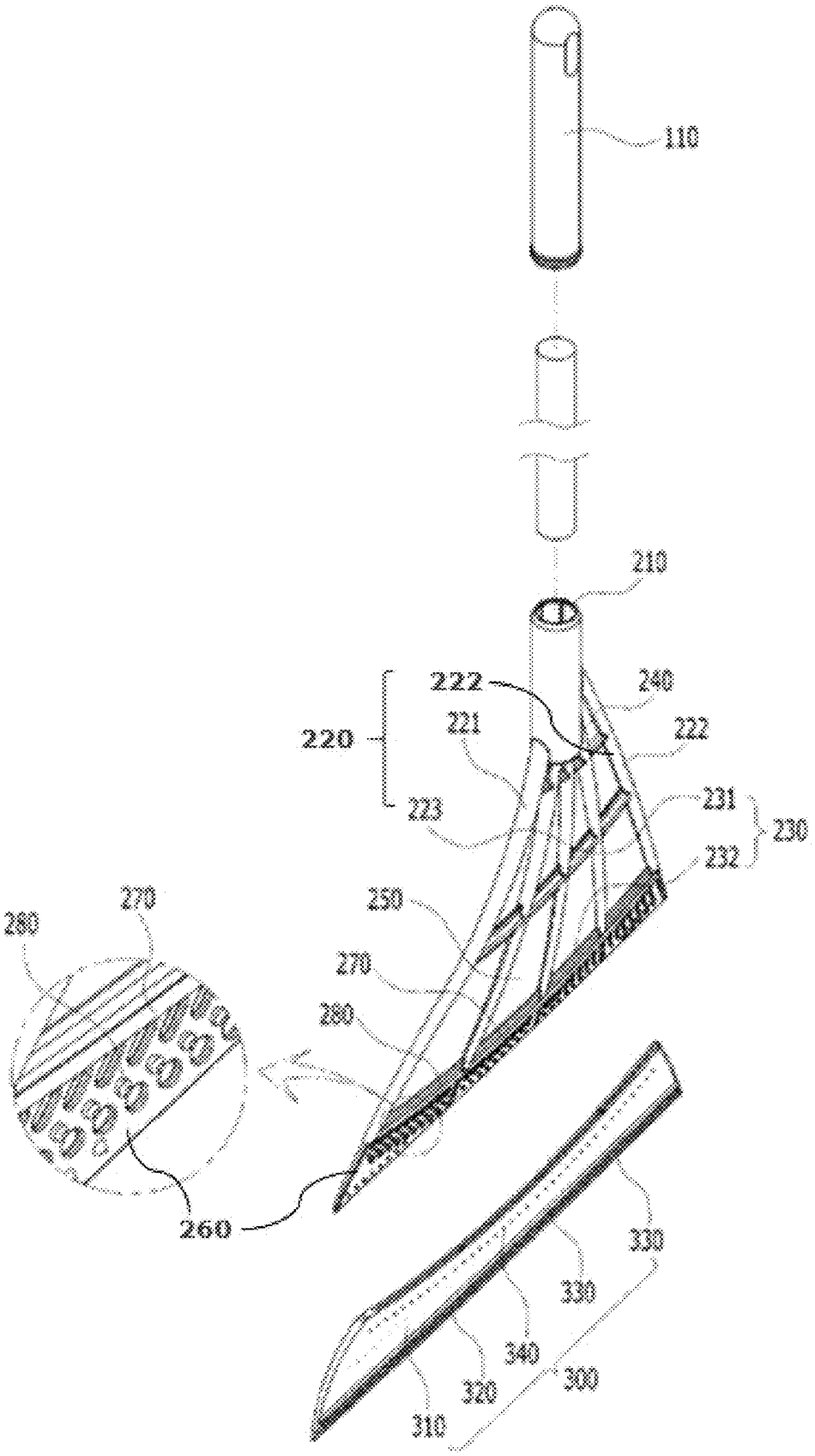
FIG. 2 is an exploded perspective view of FIG. 1.
Figure 3:
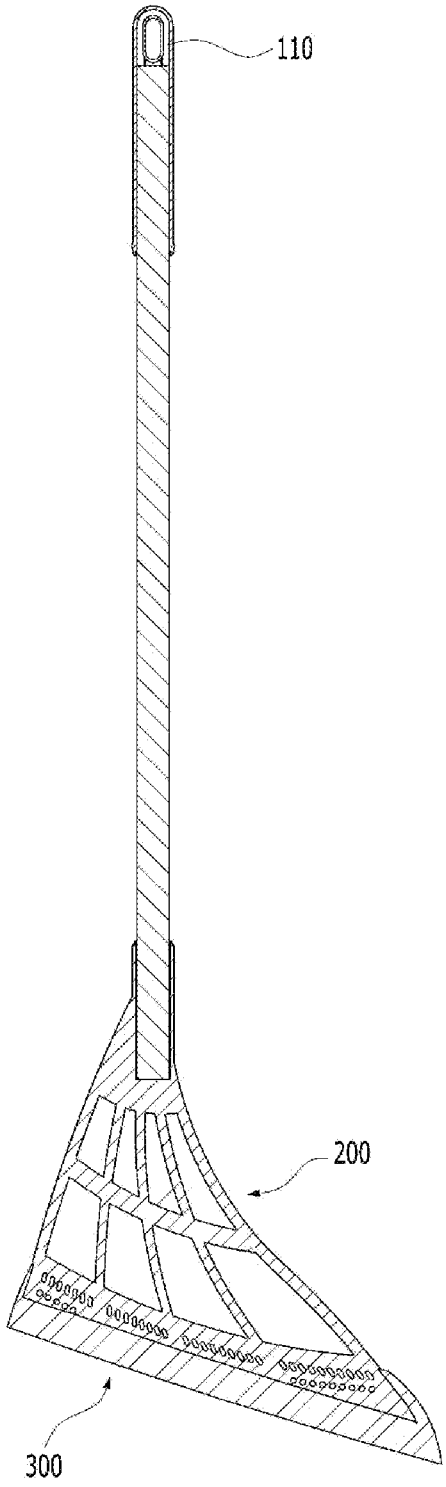
FIG. 3 is a cross-sectional view showing a main cleaner and an auxiliary cleaner of a cleaning device having the auxiliary cleaner according to an embodiment of the inventive concept.
Figure 4:
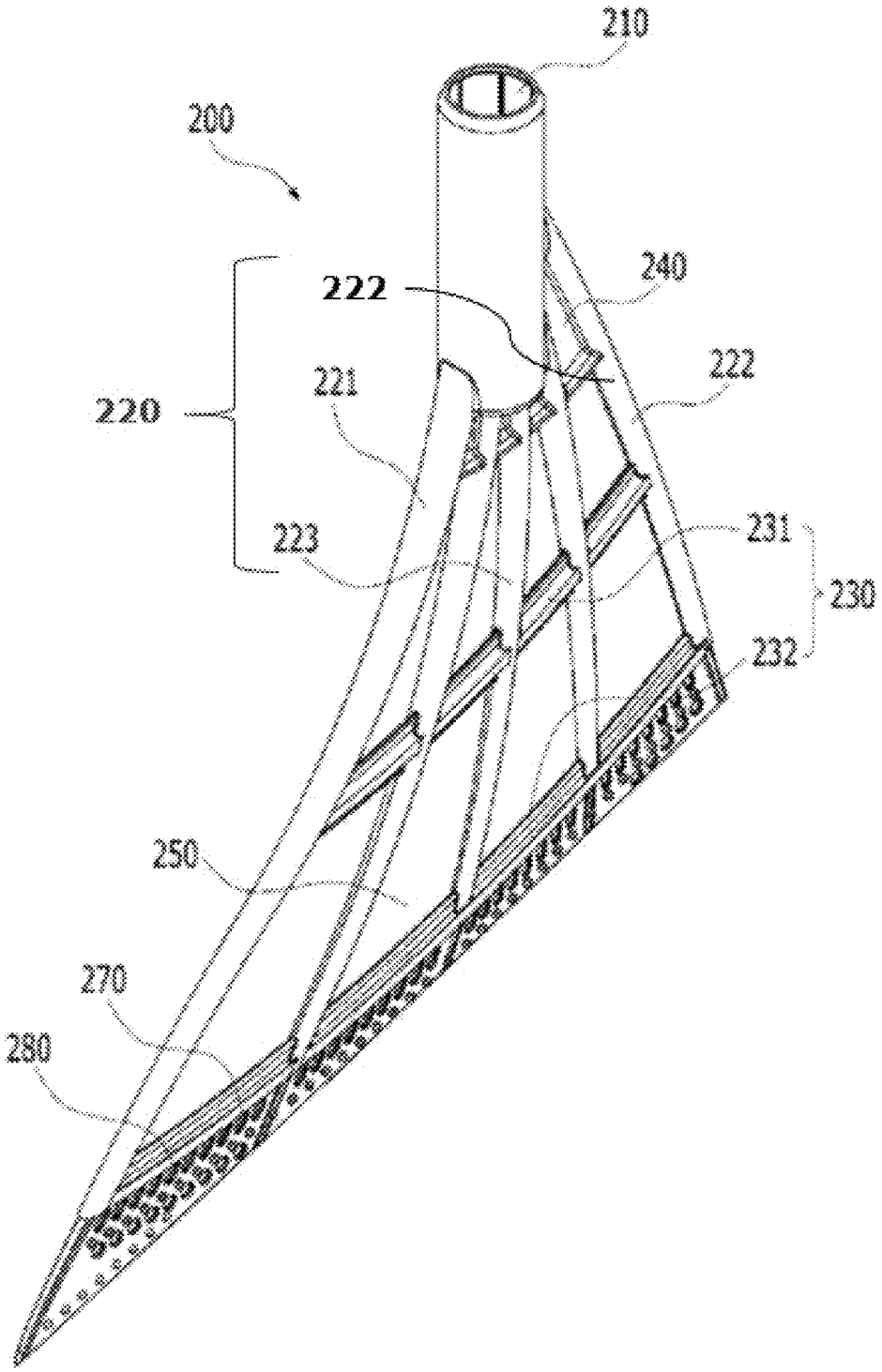
FIG. 4 is an enlarged perspective view showing in detail a main cleaner of a cleaning device having an auxiliary cleaner according to an embodiment of the inventive concept.
Figure 5:
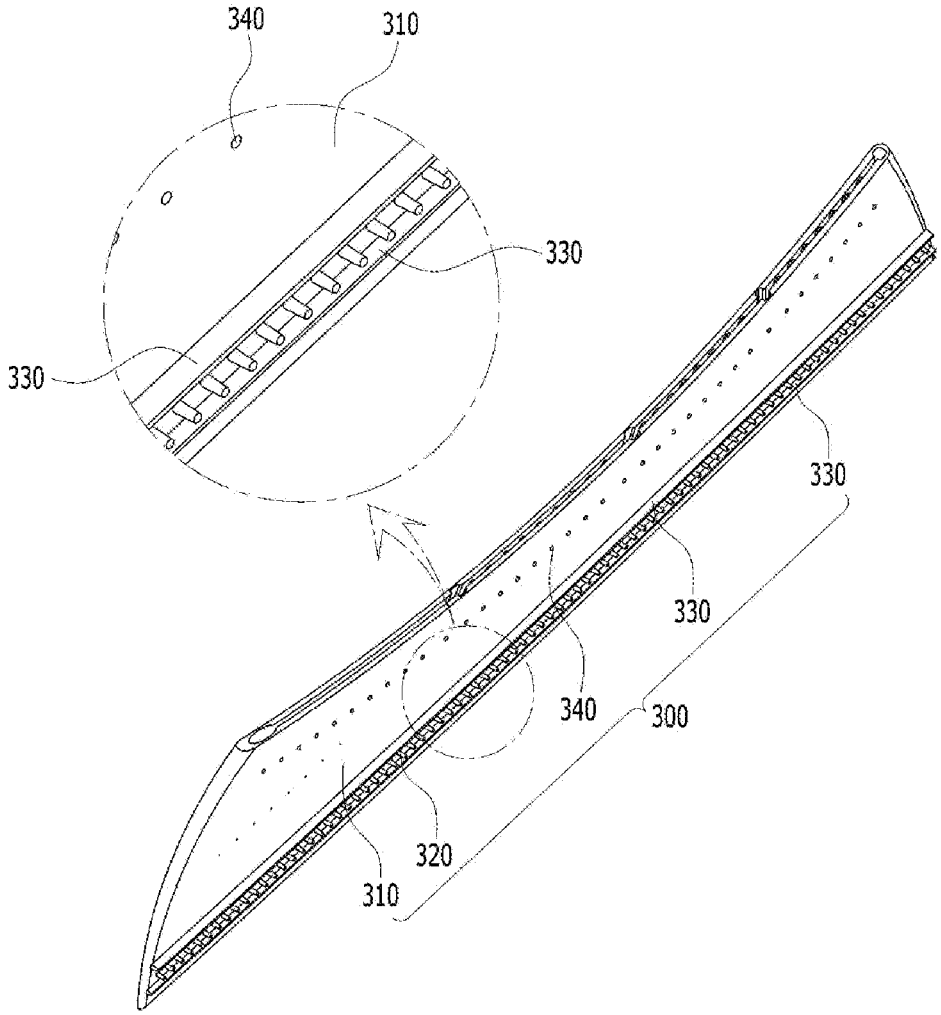
FIG. 5 is an enlarged perspective view showing in detail an auxiliary cleaner of a cleaning device having the auxiliary cleaner according to an embodiment of the inventive concept.
Figure 6:
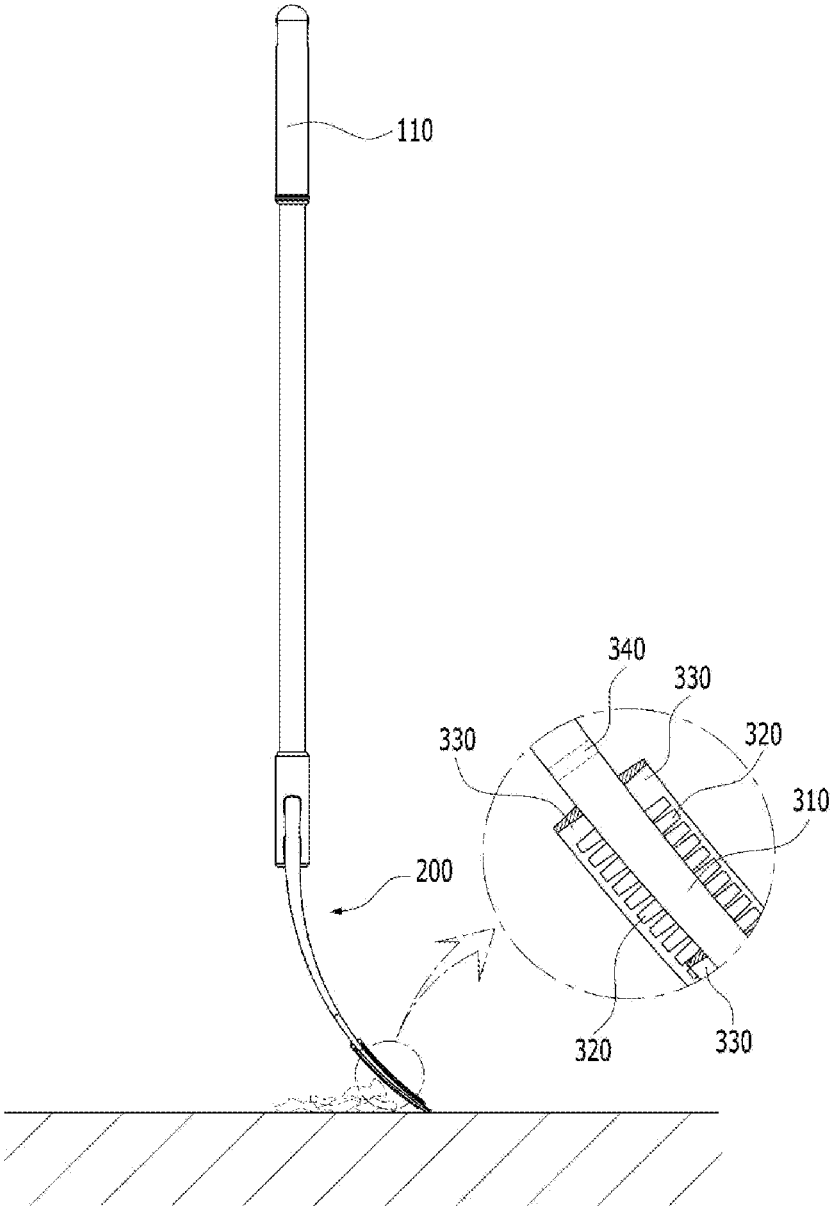
FIG. 6 shows a side view of a use example of a cleaning device having an auxiliary cleaner according to an embodiment of the inventive concept.

FIG. 1 is a front view showing an overall shape of a cleaning device having an auxiliary cleaner according to an embodiment of the inventive concept. FIG. 2 is an exploded perspective view of FIG. 1. FIG. 3 is a cross-sectional view showing a main cleaner and an auxiliary cleaner of a cleaning device having the auxiliary cleaner according to an embodiment of the inventive concept. FIG. 4 is an enlarged perspective view showing in detail a main cleaner of a cleaning device having an auxiliary cleaner according to an embodiment of the inventive concept. FIG. 5 is an enlarged perspective view showing in detail an auxiliary cleaner of a cleaning device having the auxiliary cleaner according to an embodiment of the inventive concept. FIG. 6 shows a side view of a use example of a cleaning device having an auxiliary cleaner according to an embodiment of the inventive concept.

As shown in FIG. 1 and FIG. 2, a cleaning device 10 having an auxiliary cleaner according to an embodiment of the inventive concept includes a grip 100, a main cleaner 200 and an auxiliary cleaner 300.

More specifically, as shown in FIG. 1 to FIG. 3, the cleaning device 10 with the auxiliary cleaner according to an embodiment of the inventive concept includes the grip 100 embodied as a bar extending in a vertical direction, the rigid main cleaner 200 having a tubular housing 210 coupled to a bottom of the grip and a plurality of frames extending from a bottom of the housing and spaced apart from each other by a predefined spacing, and the auxiliary cleaner 300 coupled to a bottom of the cleaner 200 and contacting a cleaning target as the cleaner 200 deforms.

Referring to FIG. 1 and FIG. 2, the grip 100 may be formed in a bar shape extending in a vertical direction such that the user may grip the bar.

In this connection, the grip 100 is coupled to a top of the main cleaner 200 and the auxiliary cleaner 300 in contact with a floor. The grip 100 has a grip cover 110 defining a top thereof which the user may grip.

Referring to FIG. 2 and FIG. 4, the main cleaner 200 may be made of a rigid material. The main cleaner 200 include the tubular housing 210 coupled to a bottom of the grip, and the plurality of frames extending from a bottom of the housing and spaced apart from each other by a predefined spacing.

In this connection, the housing 210 is constructed to couple the main cleaner 200 and the grip 100 to each other. That is, the housing 210 is formed in a tubular shape of a diameter that is smaller than or equal to a diameter of the grip 100 to allow the grip 100 to be pressure-fitted into the housing 210.

In one example, the main cleaner 200 includes a main frame 220, a reinforcing frame 230, and a twist-preventing portion 240.

The main frame 220 extends vertically from one side of a bottom of the housing 210. The main frame 220 may have a first frame 221 extending in an inclined manner and in a streamline shape from an outer surface of one side of the housing 210, a second frame 222 extending in a curved shape from an outer surface of the other side of a bottom of the housing 210, and a plurality of middle frames 223 vertically extending and disposed between the first and second frames and being arranged horizontally.

In this connection, the main frame 220 is formed on a bottom of the housing 210 using injection molding. The twist-preventing portion 240 which will be described later may disallow the main frame 220 to be deformed during the injection molding. The main frame 220 may have the plurality of the frames formed to extend from the housing 210.

The first frame 221 and the second frame 222 serve to form an outer framework of the main cleaner 200.

The plurality of middle frames 223 may be arranged between the first frame 221 and the second frame 222 to form an inner framework of the main cleaner 200.

Referring to FIG. 4, the reinforcing frame 230 may include a first reinforcing frame 231 connecting vertical middle portions of the first and second and middle frames of the main frame 220 with each other in a horizontal direction, and a second reinforcing frame 232 connecting bottoms of the first and second and middle frames of the main frame 220 with each other in a horizontal direction and being spaced downwardly from the first reinforcing frame 231.

That is, the reinforcing frame 230 is constructed to withstand a tensile force of the main frame 220 as generated when the main cleaner 200 is placed on the cleaning target and is pushed in one direction to sweep the cleaning target. Thus, the main cleaner 200 may be prevented from being bent while the main cleaner 200 is flexible.

Further, the reinforcing frame 230 prevents the main frame 220 from relaxing due to a pressure in the injection molding when the main cleaner 200 is injection-molded, thereby to prevent the main frame 220 from twisting.

That is, the reinforcing frame 230 may structurally support the main frame 220.

In this connection, the reinforcing frame 230 has a coupler 260 extending from the second reinforcing frame 232 and being embodied as a plate. The coupler 260 will be described later. The coupler 260 may act to integrally couple the main cleaner 200 formed via first injection molding to the auxiliary cleaner 300 formed via second injection molding.

The twist-preventing portions 240 are formed in a plate shape and is disposed between the first and second and middle frames of the main frame 220 to integrally connect the main frame 220 to the bottom of the housing 210. In this manner, when the main cleaner 200 is formed via the first injection molding, the twist-preventing portions 240 minimize twist of the main frame.

Further, as shown in FIG. 4, the main cleaner 200 has spaces 250.

The spaces 250 are defined between the first and second and middle frames of the main frame 220 and the reinforcing frame 230. Thus, the main cleaner 200 may be formed in a grid shape so that the cleaning target may be efficiently cleaned while a manufacturing cost may be reduced in large-scale production.

Further, when a user grips the grip 100 and moves the grip 100 in one direction to clean the cleaning target, the spaces 250 serve to minimize scattering of the cleaning target in a form of powder as air passes through the spaces.

In one example, as shown in FIG. 2 and FIG. 4, the main cleaner 200 further includes the coupler 260, a coupling groove 270 and a coupling protrusion 280.

The coupler 260 extends in a plate shape from the second reinforcing frame 232.

The coupling groove 270 may include a plurality of grooves penetrating one surface of the coupler 260.

That is, the coupling groove 270 serves to increase an integrally coupling force between the main cleaner 200 formed via the first injection molding and the auxiliary cleaner 300 formed via the second injection molding.

The coupling protrusion 280 protrudes from both side surfaces of the coupler 260 and is adjacent to the coupling grooves 270, and plays the same role as that of the coupling groove 270 as described above.

Referring to FIG. 2 and FIG. 5, the auxiliary cleaner 300 is coupled to a bottom of the main cleaner 200 and contacts the cleaning target as the main cleaner 200 deforms.

To this end, the auxiliary cleaner 300 includes a scraper 310, a main protrusion 320 and an auxiliary protrusion 330.

The scraper 310 is connected to the bottom of the main cleaner 200 and is formed in a plate shape having both lateral ends inclined downwards.

In particular, the scraper 310 is made of a rubber material and is soft and flexible to collect the cleaning target.

In this connection, the rubber material is preferably selected from NR (natural rubber), BR (butadiene rubber), SBR (stylrene butadiene rubber), and NBR (acrylonitrile butadiene rubber).

Referring to FIG. 5 and FIG. 6, the main protrusion 320 includes a plurality of main protrusions 320 arranged along a longitudinal direction of the scraper 310 and protruding on both side surfaces thereof.

In other words, the main protrusion 320 protrudes into a cylindrical shape having a predetermined length. One end of the main protrusion 320 is sharp. The main protrusions 320 may be arranged and spaced from each other by a constant spacing along a length direction of the scraper 310 and may be used to remove the cleaning target caught in an unevenness, a tile and a groove.

In other words, a plate surface of the scraper 310 may be used to sweep the cleaning target on a flat surface. The main protrusion 320 may sweep the cleaning target caught in an unevenness, a tile and a groove using the sharp tip to remove dirt. In this connection, the cleaning target caught in an unevenness, a tile and a groove may not be removed by the plate surface of the scraper 310.

Two auxiliary protrusions 330 protrude in a wall shape and extend along a longitudinal direction and are disposed above and below the main protrusion 320 respectively.

That is, the auxiliary protrusions 330 may include an upper protrusion and a lower protrusion. The upper auxiliary protrusion 330 serves to collect dust and dirt on a floor. Then, the dust and dirt as gathered moves toward a bottom of the scraper 310.

The auxiliary protrusions 330 may act to prevent the dust and dirt from escape the scraper 310 behind the scraper 310.

The cleaning device 10 having the auxiliary cleaner according to an embodiment of the inventive concept may be fabricated by forming the main cleaner 200 via the first molding, and inserting the first molded main cleaner 200 into a mold and performing the second molding to form the auxiliary cleaner 300. In this connection, the main cleaner 200 is integrally coupled to the auxiliary cleaner 300 via the coupler 260 such that the auxiliary cleaner 300 surrounds the coupler 260. Further, in this connection, each of the first molding and second molding may include injection molding.

In particular, the first molding refers to a process of forming the main cleaner 200. In this connection, the twist-preventing portion 240 is formed to prevent twisting and deformation which otherwise occur when the housing 210 and the grip 100 are coupled to each other.

The reinforcing frame 230 is formed on the main frame 220 to maintain a uniform pressure in the injection molding. Thus, the main frame 220 is prevented from being relaxed and twisted due to deformation of each of the frames of the main frame 220.

Next, the second molding refers to a process of inserting the first molded main cleaner 200 into a mold and of forming the auxiliary cleaner 300.

That is, the auxiliary cleaner 300 is formed to surround the coupler 260 formed as a portion of the main cleaner 200. In this connection, the main cleaner 200 may have the coupling groove 270 and the coupling protrusion 280 to allow the auxiliary cleaner 300 to be integrally coupled to the main cleaner 200.

In this connection, the auxiliary cleaner 300 has a plurality of support protrusions 340 on both sides of the scraper 310 as shown in FIG. 5.

The support protrusions 340 extend from both sides of the scraper 310 toward the coupler 260. The support protrusions 340 may be formed to prevent the first molded main cleaner 200 from being eccentrically biased in one direction due to an injection pressure during the second molding.

The cleaning device in accordance with the inventive concept may be fabricated by forming the main cleaner via first injection molding, and inserting the first molded main cleaner into the mold and performing second injection molding to form the auxiliary cleaner such that the main cleaner is integrally coupled to the auxiliary cleaner. Thus, the deformation or twist of the main cleaner may be prevented.

Further, the main cleaner may include the plurality of the frames and the reinforcing frame may structurally support the plurality of the frames. Thus, a production cost of the cleaning device may be reduced. Further, a user may remove the dirt while the dirt may not be attached to the main cleaner during cleansing.

Further, in the cleaning device having the auxiliary cleaner in accordance with the inventive concept, the auxiliary cleaner may replace hairs but may efficiently remove the dirt. The main protrusions and the auxiliary protrusions formed on the auxiliary cleaner may remove dirt or dust caught in an unevenness or a groove which may not be removed by a planar surface.

Furthermore, in the cleaning device having the auxiliary cleaner in accordance with the inventive concept, the upper auxiliary protrusion formed on the auxiliary cleaner serve to collect dust and dirt on a floor. Then, the dust and dirt as gathered moves downwards toward a bottom of the scraper. Then, the lower auxiliary protrusion formed on the auxiliary cleaner serve to confine the dirt and dust as gathered such that the dirt and dust are not removed from the cleaning device in an opposite direction to an direction in which the sweeping is executed.

As described above, the detailed description of the inventive concept has described a preferred embodiment of the inventive concept. This is only illustrative of a best mode of the inventive concept and does not limit the inventive concept. Further, any person with ordinary knowledge in the technical field to which the inventive concept belongs may make various modifications and alternatives without departing from a technical spirit of the inventive concept.

Accordingly, a scope of the inventive concept is not limited to the above-described embodiments. The inventive concept may be embodied in various forms of embodiments within a scope of the appended claims. Thus, any person of ordinary skill in the art may understand that modifications without departing from a gist of the inventive concept as claimed in the claims fall within the scope of the claims of the inventive concept.

What is claimed is:

1. A cleaning device having an auxiliary cleaner, the cleaning device comprising:

a bar-shaped grip coupled to a tubular housing at a bottom;

a rigid main cleaner including the tubular housing and a plurality of frames connected to a bottom of the tubular housing; and the auxiliary cleaner coupled to a coupler extending from the bottom of the frames, wherein the coupler is inserted into an inside of the auxiliary cleaner such that the auxiliary cleaner surrounds the coupler, wherein the auxiliary cleaner includes:

a plate-shaped scraper connected to a bottom of the main cleaner;

a plurality of main protrusions arranged along a longitudinal direction of the scraper and protruding from both lower surfaces of the scraper; and auxiliary protrusions protruding in the form of a wall in a longitudinal direction of the scraper from at least one side of a top and a bottom of the main protrusions.

2. The cleaning device of claim 1, wherein the frames of the main cleaner includes:

a main frame including: a plurality of middle frames spaced apart from each other between a first frame extending from one side of the bottom of the at least one housing extending in a vertical direction and a second frame extending from the other side of the outer surface of the bottom of the housing;

a reinforcing frame including: a first reinforcing frame connecting middle portions of the main frame in a horizontal direction; and a second reinforcing frame spaced apart from the first reinforcing frame and connecting bottoms of the main frame; and a twist-preventing portion integrally connecting a top of the main frame connected to the bottom of the housing.

3. The cleaning device of claim 2, wherein the main cleaner further includes a plurality of coupling grooves and a plurality of coupling protrusions.

4. The cleaning device of claim 2, wherein spaces are formed between the main frame and the reinforcing frame.

5. The cleaning device of claim 2, wherein the main cleaner is formed via first molding which performs injection molding, the auxiliary cleaner is formed via second molding which inserts the first molded main cleaner into a mold.

* * * * *